US007520948B2

(12) United States Patent
Tavy et al.

(10) Patent No.: US 7,520,948 B2
(45) Date of Patent: Apr. 21, 2009

(54) METHOD OF PREPARING A SUBSTRATE TO RECEIVE A COVERING

(75) Inventors: Armen Tavy, Plant City, FL (US); Jeffrey Maguire, Andover, CT (US)

(73) Assignee: Tavy Enterprises, Inc., Vernon, CT (US)

( * ) Notice: Subject to any disclaimer, the term of this patent is extended or adjusted under 35 U.S.C. 154(b) by 0 days.

(21) Appl. No.: 11/086,897

(22) Filed: Mar. 22, 2005

(65) Prior Publication Data

US 2006/0217017 A1 Sep. 28, 2006

(51) Int. Cl.

| | |
|---|---|
| ***B29C 65/48*** | (2006.01) |
| ***B32B 37/00*** | (2006.01) |
| ***B32B 17/04*** | (2006.01) |
| ***B32B 17/06*** | (2006.01) |
| ***E04B 1/62*** | (2006.01) |
| ***E04G 23/02*** | (2006.01) |
| ***C09J 5/02*** | (2006.01) |
| *E04F 13/07* | (2006.01) |
| *E04B 1/16* | (2006.01) |

(52) U.S. Cl. ..... 156/71; 156/280; 156/305; 52/741.41; 52/745.05; 52/746.1; 52/747.11

(58) Field of Classification Search ..... 156/71, 156/278, 280, 305; 427/180, 196, 203, 407.1; 52/741.4, 741.41, 742.1, 745.05, 746.1, 747.11, 52/74.41

See application file for complete search history.

(56) References Cited

U.S. PATENT DOCUMENTS

| | | | | |
|---|---|---|---|---|
| 3,532,482 | A * | 10/1970 | Weisbart | 65/36 |
| 3,765,972 | A * | 10/1973 | Wesp | 156/71 |
| 5,019,195 | A * | 5/1991 | Skinner | 156/71 |
| 5,116,439 | A * | 5/1992 | Raus | 156/71 |
| 6,167,668 | B1 * | 1/2001 | Fine et al. | 52/403.1 |
| 6,354,058 | B1 * | 3/2002 | Lewis | 52/749.11 |
| 6,413,335 | B1 | 7/2002 | Drake, Jr. | |
| 6,630,041 | B1 | 10/2003 | Reiber | |
| 6,698,149 | B1 | 3/2004 | Ruchgy | |
| 6,854,241 | B1 | 2/2005 | Pelosi, Jr. | |
| 6,964,986 | B2 * | 11/2005 | Bachon et al. | 524/2 |
| 2006/0174585 | A1 * | 8/2006 | Barr | 52/741.3 |

* cited by examiner

*Primary Examiner*—Philip C Tucker
*Assistant Examiner*—Sing P Chan
(74) *Attorney, Agent, or Firm*—Duane Morris LLP

(57) ABSTRACT

The invention relates to materials and methods for preparing a surface to receive a covering. A non-woven fabric is adhered to the surface using an adhesive, and a cementitious bondant is applied to the fabric, either before or after adhering it to the surface. The covering can thereafter be bound to the bondant. In this way, the covering is adhered to the surface by way of an underlayment that can improve the adhesion of the covering to the surface, simplify installation, prevent propagation of cracks from the surface to the covering, and prevent surface topography from affecting the smoothness of the covering.

19 Claims, 4 Drawing Sheets

METHOD OF PREPARING A SUBSTRATE TO RECEIVE A COVERING

BACKGROUND OF THE INVENTION

The invention relates generally to the field of covering a surface, such as application of tiles to the floor of a building.

In the building and decorating arts, there are many situations in which a covering is laid over top of a surface. Well known examples include installation of tile, carpet, paint, and wallpaper. Such installations are routinely performed both by building tradesmen and relative novices. Home renovation, for example, is a rapidly growing industry. Coverings commonly applied to surfaces include tile, stone, brick, stucco, ceramic, porcelain, laminate, plaster, marble, slate, wood, wood composites, vinyl, plastic, and carpet.

A decorative finish can often be applied directly to a surface. However, many existing surfaces are not designed to receive additional coverings, and chemical or topographical characteristics of the existing surface can interfere with installation of a covering, yielding a poorly-bonded covering or diminishing the attractiveness of the covering. A significant need exists for a method of preparing surfaces to receive coverings that are aesthetically pleasing and structurally sound.

BRIEF SUMMARY OF THE INVENTION

The invention relates to a method of preparing a surface (e.g., a floor, wall, or ceiling) to receive a covering such as tile. The method comprises binding one face of a non-woven fabric (e.g., a fiberglass-reinforced fabric) to the surface using an adhesive (e.g., an acrylic polymer-based adhesive) and applying to the opposite face of the fabric a cementitious bondant (e.g., a skimcoat of thinset mortar) for receiving the covering. The covering can be adhered to the fabric using the bondant or, for example, second adhesive applied to the bondant. The shape of the fabric can be cut to match the shape of the surface, or it can be supplied in a pre-cut form. The fabric can also be deformed to match the surface.

The invention includes a kit for preparing a surface to receive a covering. The kit comprising an adhesive, a non-woven fabric, and a cementitious bondant as described herien. The bondant can be pre-disposed on one face of the fabric.

The invention also includes an underlayment for adapting a surface to receive a covering, the underlayment comprising a non-woven fabric having a cementitious bondant disposed on at least one face thereof.

DETAILED DESCRIPTION OF THE INVENTION

Figure 1:
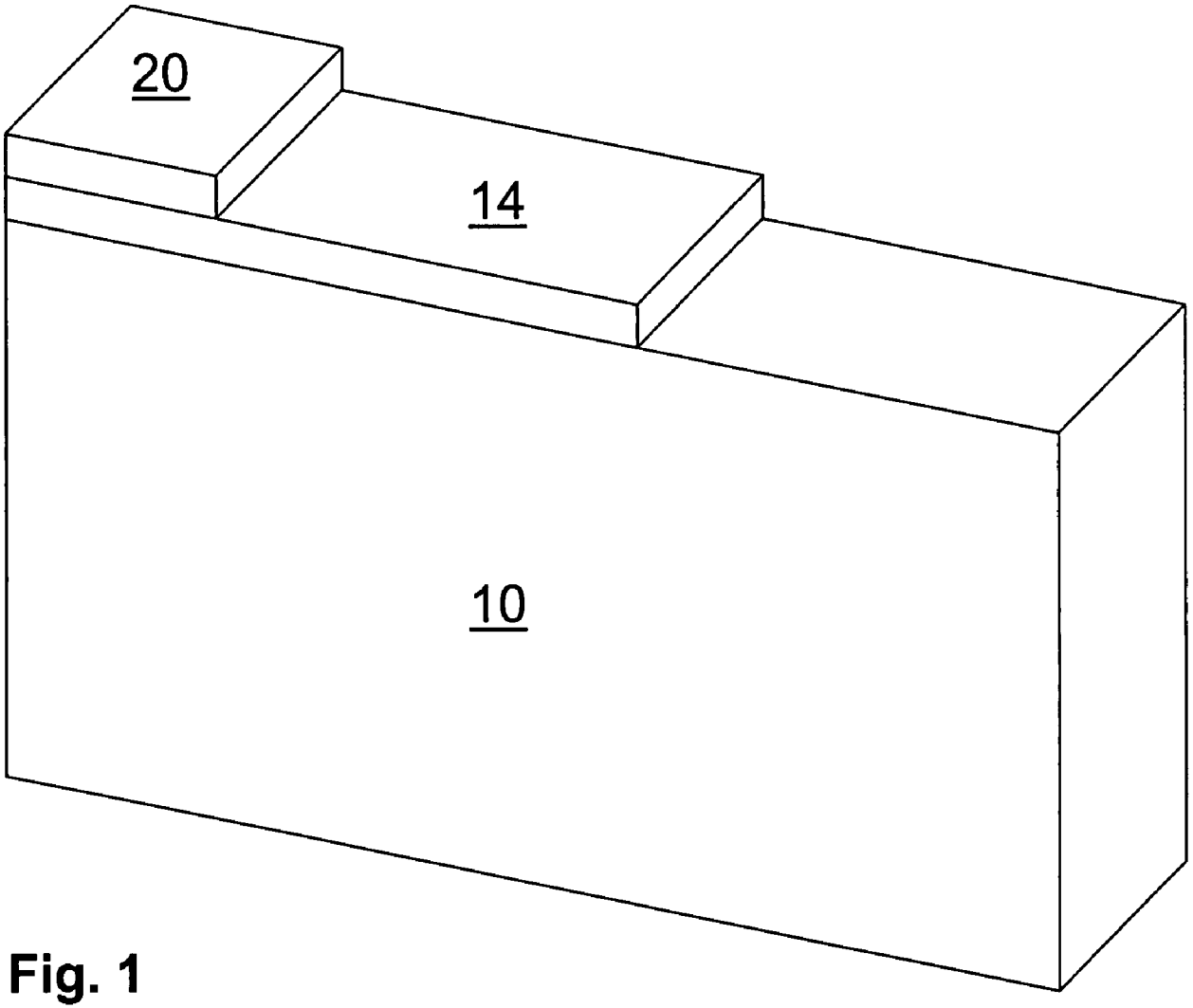
Fig. 1 Prior Art
FIG. 1 is a perspective view of a previously-known method of applying a tile 20 to a surface 10 using a thinset mortar 14. The drawing is not made to scale.
Figure 2:
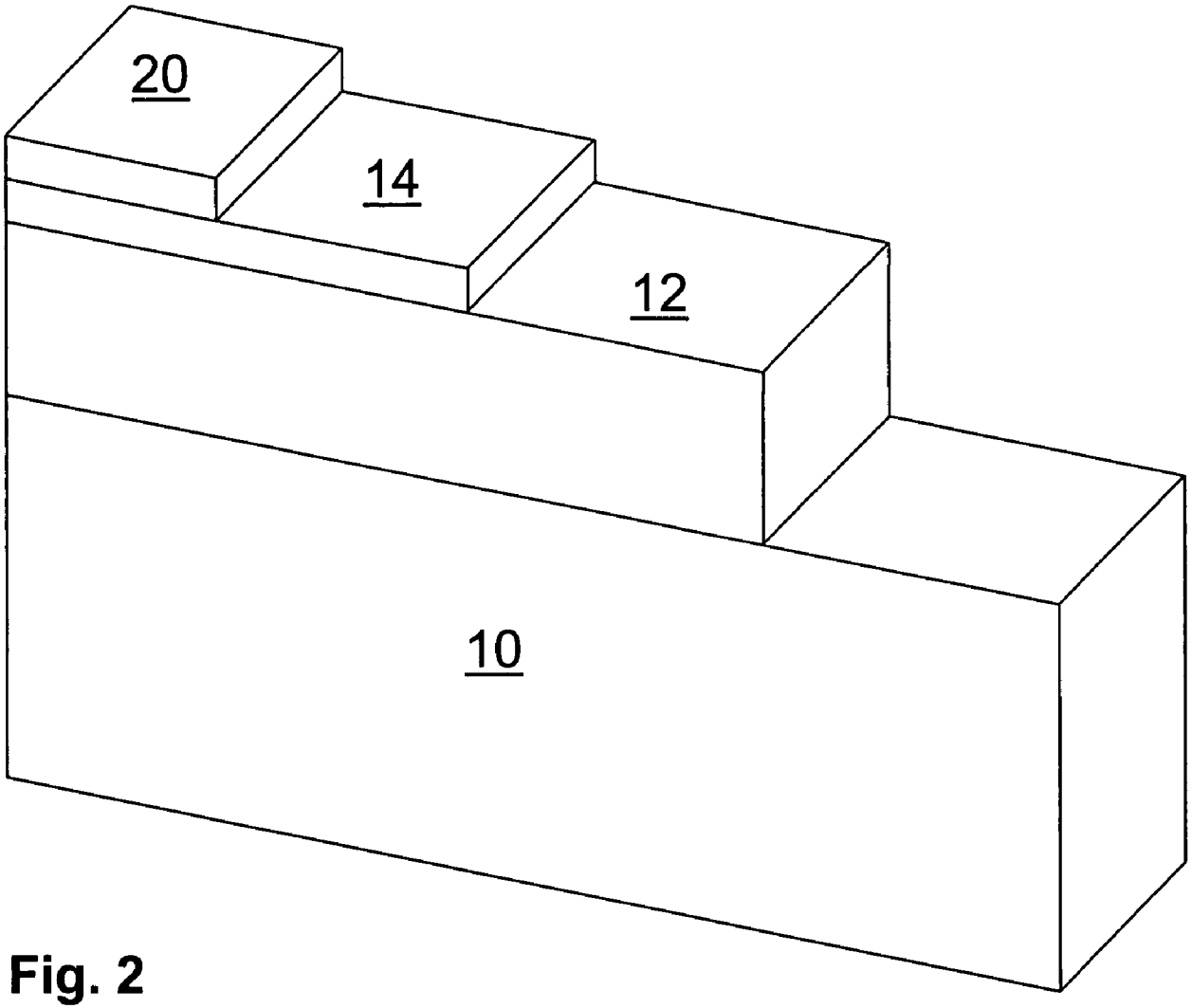
Fig. 2 Prior Art
FIG. 2 is a perspective view of a previously-known method of applying a tile 20 to a surface 10 using a thinset mortar 14 set atop a mortar bed 12. The drawing is not made to scale.
Figure 3:
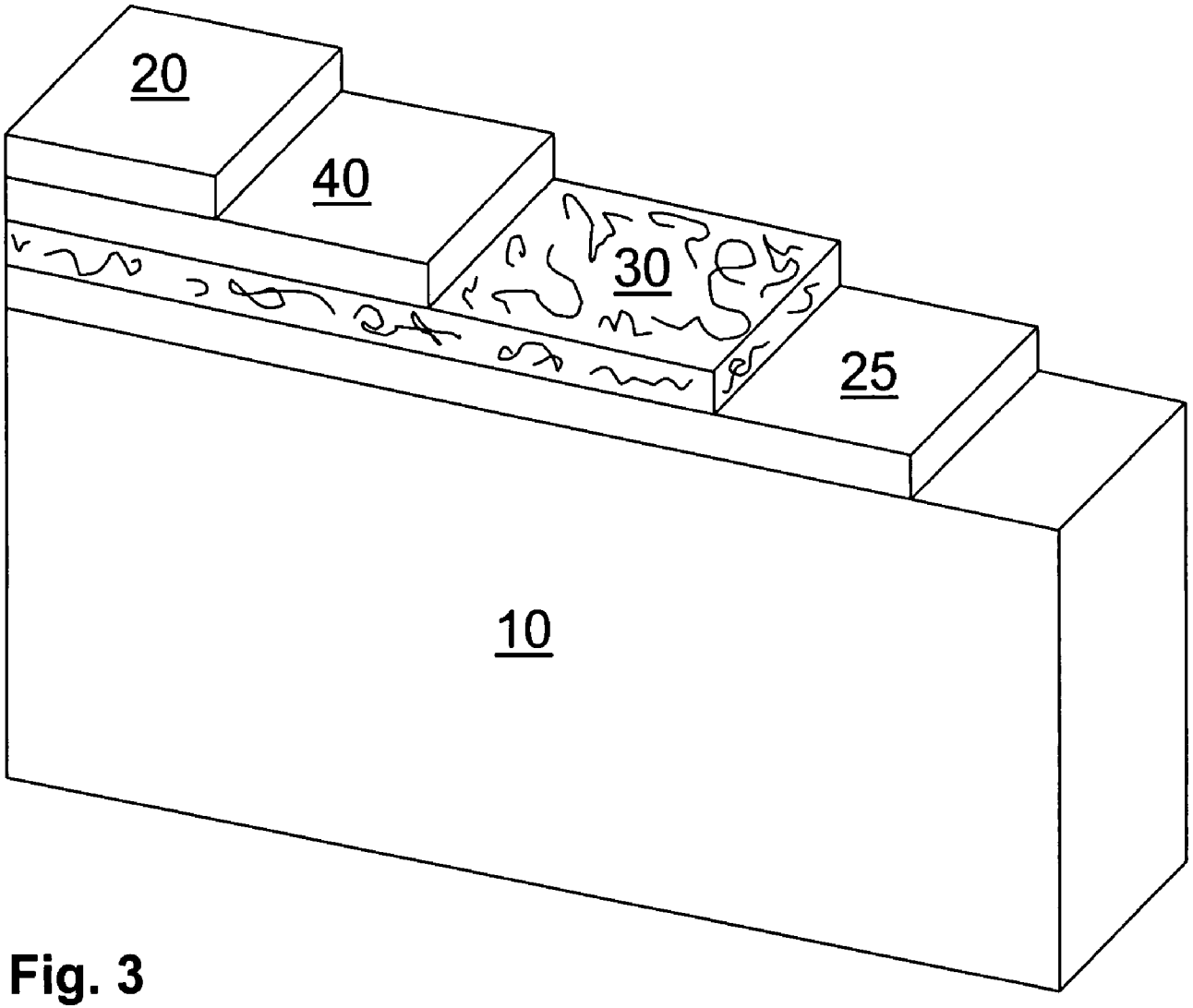
FIG. 3 is a perspective view of a method described herein for applying a tile 20 to a surface 10 by adhering a non-woven fabric 30 to the surface 10 using an adhesive 25. The tile 20 is bound to the fabric 30 by a bondant 40. The drawing is not made to scale.
Figure 4:
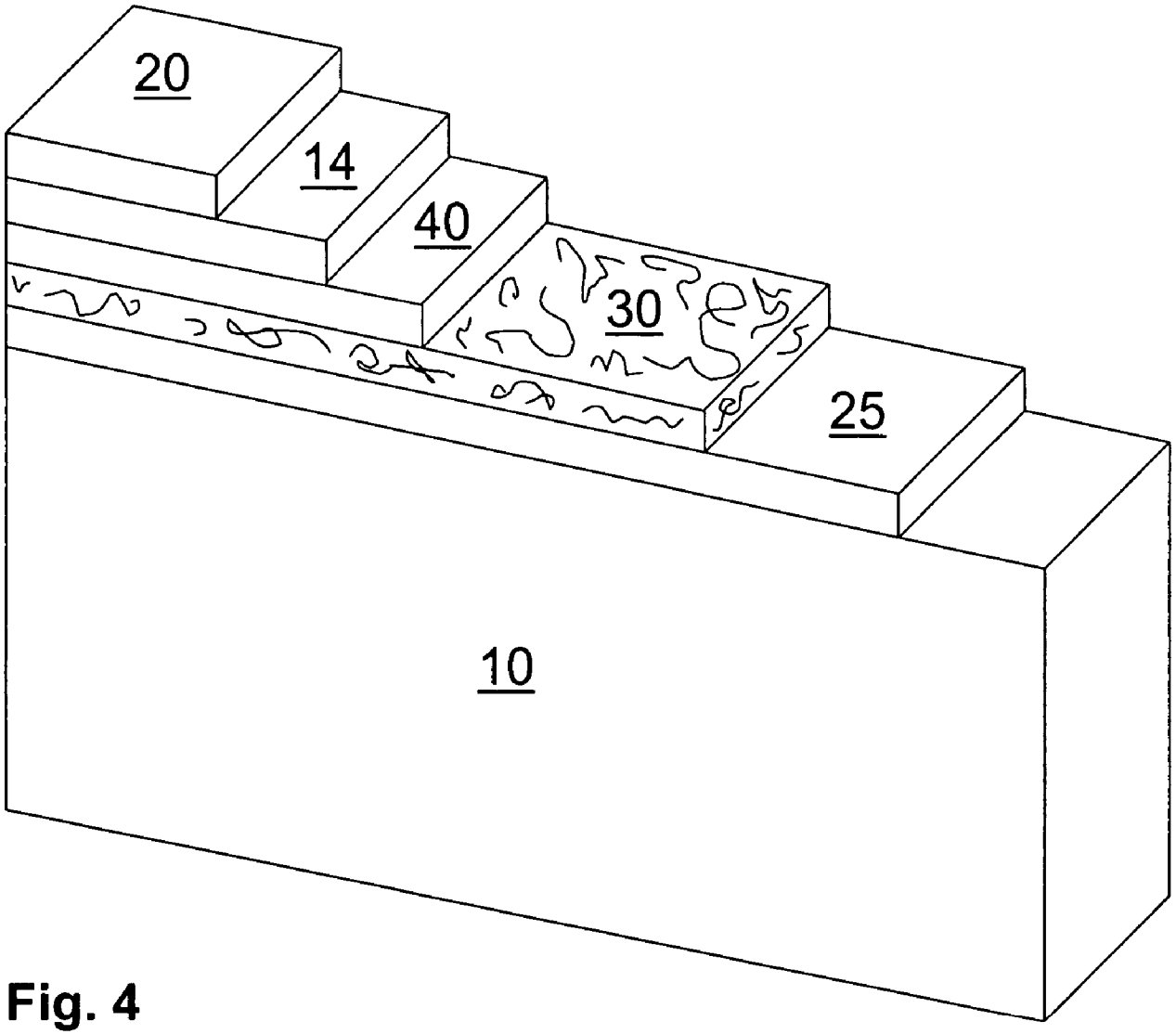
FIG. 4 is a perspective view of a method described herein for applying a tile 20 to a surface 10 by adhering a non-woven fabric 30 to the surface 10 using an adhesive 25. The tile 20 is bound to the fabric 30 by way of a thinset mortar 14 set atop a bondant 40 applied to the fabric 30. The drawing is not made to scale.

The present invention relates to a method of preparing a surface to receive a covering by installing a non-woven fabric underlayment between the surface and the covering. One face of the fabric is secured to the surface using an adhesive. The other face of the fabric has a cementitious bondant disposed thereon. It is immaterial whether the bondant is applied to the fabric before or after adhering the fabric to the surface, or even simultaneously with such adhesion. The covering is secured to the bondant, and thence to the fabric, the adhesive, and the surface.

Definitions

As used herein, each of the following terms has the meaning associated with it in this section.

An "adhesive" is a composition which, when interposed between a surface and a non-woven fabric causes the surface and the fabric to bind in a steady or firm way. Adhesives include compositions that cause such binding substantially immediately or after a period of drying or setting.

A "cementitious bondant" is a composition which includes Portland cement or a hydrated solid formed from combining Portland cement with water.

A "non-woven fabric" is a flat sheet made from discrete fibers (or, in the case of plastics, sometimes from molten plastic or plastic film) that are held together by a mechanism other than ordered interweaving. Examples of non-woven fabrics include randomly-entangled fibrous sheets, chemically-bonded fibrous sheets, thermally-bonded fibrous sheets, and others known in the art.

A "thinset" mortar is a blend of Portland cement, finely graded sand, water, and other optional ingredients (e.g., water-retaining compounds, fibrous or polymeric reinforcements, and colorants) combined in amounts that adhere well in a thin layer (e.g., a layer generally not greater than one half of an inch in thickness). The terms "dryset" and "drybond" mortars are sometimes used in the art to describe thinset mortars. Many thinset mortar compositions are known in the art.

A "skimcoat" of mortar is a thin (typically not greater than three-sixteenths of an inch in thickness) layer of mortar. A skimcoat is applied to the face of a surface in order to improve adherance of the bondant. In the trade, a skimcoat refers to mortar layer for keying-in of a bondant to a surface.

Detailed Description

The invention relates to a method of preparing a surface to receive a covering. For example, the methods described herein are suitable for applying ceramic tile, wood tile, wallpaper, paint, or carpeting to an interior surface of a building, such as a floor, a ceiling, or a wall. The methods are useful in new building construction settings, and are also useful in renovation and remodeling applications. An advantage of the methods described herein in renovation settings is that a covering can be laid over top of an existing covering, even if the existing covering has a topography that is undesirable as a substrate for the new covering. By way of example, the methods described herein can be used to lay tile over top of an existing patterned linoleum floor or to paint over top of an existing wood-paneled wall.

The methods described herein involve binding one face of a non-woven fabric to the surface to which the covering is to be applied. The fabric is bound to the surface using an adhesive. After the fabric is bound to the surface, the adhesive can optionally be permitted to set or dry. A cementitious bondant is bound to the opposite face of the fabric, before, after, or while binding the fabric to the surface. The bondant can also be permitted to set or dry prior to proceeding. The covering is bound to the bondant, either directly (i.e., by using the bondant to set or dry in contact with both the fabric and the covering) or by way of one or more compositions for adhering the covering to the bondant.

In one embodiment, the adhesive is a multi-purpose acrylic polymer-based adhesive, the fabric is a fiberglass-reinforced non-woven fabric, and the bondant is a thin layer (ca. 1/32 inch) of thinset mortar disposed in a substantially smooth layer upon the fabric. In this embodiment, the components are useful for preparing substantially any surface that is capable of binding with the adhesive for application of ceramic tile thereto. The adhesive can be applied to the surface to be tiled in such a way (e.g., by troweling and leveling) that the adhesive wholly or partly fills cracks, channels, hollows, and other minor topographical irregularities in the surface, yielding a smooth surface for receiving tile once the fabric is adhered thereto. The smooth mortar surface is well-suited for bonding with additional mortar applied thereto for the purpose of adhering ceramic tile to mortared face of the fabric. Alternatively, mortar for adhering tile can be applied directly to the (not previously mortared) fabric.

Among the advantages of the methods described herein is that they can be used to encapsulate or enclose harmful or undesirable substances that may be present on or at a surface to which a covering is to be applid. By way of example, some older flooring materials contained asbestos or other undesirable compounds. By coating such material with adhesive, adhering a non-woven fabric to the surface, skim-coating the fabric with mortar, and setting a covering atop the mortar with a bondant, the undesirable materials can be isolated. This can be an attractive and less expensive alternative to removal of the pre-existing surface.

The components used in the methods described herein are now described in greater detail.

Adhesive

The adhesive useful in the methods described herein can be substantially any composition that will bind the non-woven fabric described herein to the surface to which the covering is to be applied with sufficient tenacity and stability that the covering bound to the fabric is able to withstand the normal wear and tear to which the covering is subjected during its anticipated useful life. The adhesive is preferably flexible when set or dried. The chemical identity and nature of the adhesive are not critical. For example, for cosmetic applications in which the covering need merely remain attached to the surface and the covered surface will be subjected to little or no physical stresses, it can be sufficient if the adhesive binds the fabric to the surface with no more than the minimum tenacity necessary to hold the fabric in place when the covering is bound to the fabric. Indeed, in situations in which reversibility of fabric installation is desirable, it is preferable that the adhesive bind the fabric to the surface with little more tenacity than required for stable installation of the fabric and covering. By contrast, in a situation (e.g., a ceramic tile floor or wall in a public restroom) in which significant stresses, wear, and tear are anticipated, the adhesive must bind the fabric to the surface with sufficient tenacity and stability that the fabric will not significantly separate from the surface under the conditions of normal use. Selection of an adhesive of sufficient tenacity, flexibility, and stability for a particular application is within the ken of a skilled artisan in this field.

Desirable characteristics of an adhesive depend on the anticipated or desired use of the covered surface, and a skilled artisan is able to select a desirable adhesive by considering those uses and the known properties of adhesives. By way of example, ceramic tile is sometimes used to provide a substantially waterproof covering for a surface. Imperfections in the tile, the grout or caulk between the tiles or along seams in the tile, the grout or caulk between the tiles and fixtures (e.g., water-carrying pipes) that extend through the tiled surface, or some combination of these, commonly result in at least a limited amount of water penetrating or by-passing the tile surface and reaching the point at which the tile is attached to the underlying surface. In such an application, tile installed as described herein would be bound to a non-woven fabric attached to the underlying surface by an adhesive, and the adhesive should be selected such that the tenacity and stability with which it binds the fabric to the surface is not significantly eroded upon occasional contact with water. Similarly, for a tiled surface which is subjected to significant vibration, an adhesive that is not loosened or shattered by vibration (e.g., an adhesive that exhibits significant elasticity, such as a latex-based adhesive) is indicated.

The adhesive holds the non-woven fabric to the surface to be covered so as to provide a relatively smooth surface for receiving the covering. A desirable characteristic of the adhesive is that it retains the conformation of the applied fabric, such as upon drying or setting of the adhesive. Put another way, the adhesive should exhibit substantial dimensional stability of the fabric between the time the fabric is initially adhered to the surface and the time after which the adhesive has dried or set. For example, where a smooth fabric surface is desired (e.g., for application of ceramic tile thereto) following adhesion of the fabric to the surface, drying of the adhesive between the fabric and the surface should not induce wrinkling of the fabric.

Keeping in mind the non-criticality of the identity of the adhesive apart from the requirements imposed by the anticipated use of the covered surface, substantially any adhesive can be used in the methods described herein, provided it satisfies those requirements. For example, suitable adhesives can include epoxies, hot melt glues, contact cements, carpenter's glue, polyvinyl acetates, latex adhesives, silicone adhesives, acrylic adhesives, and cyanoacrylate adhesives. Two or more compatible adhesives may be used in combination if desired.

When a non-woven fabric is used in the methods described herein for application of ceramic tile to a surface, a flexible adhesive capable of tenaciously binding the fabric to a wide range of substrates can be used. By way of example, an acrylic polymer-based adhesive can be used. Use of a widely suitable adhesive can remove the need to closely scrutinize the suitability of multiple candidate adhesives in common situations. For example, a relatively flexible adhesive that has been found to be an adhesive suitable for adhering the fabric to a wide variety of surfaces, including wood, linoleum, ceramic tile, and others has a composition of about 15% acrylic polymers, 15% hydrocarbon resins, 10% hydrocarbon oil, 43% water, and 16% inert filler(s). The adhesive preferably includes not more than about 1% of a suitable stabilizer for the adhesive composition.

Non-Woven Fabric

In the methods described herein, a non-woven fabric is used as an underlayment for a covering applied to a surface. The fabric is adhered to the surface using an adhesive, and the covering is attached to the fabric by way of a bondant. The covering can be attached to the fabric directly by the bondant (i.e., the bondant directly contacts and adheres to both the fabric and the covering) or indirectly, by way of a second adhesive that binds the covering to the bondant (i.e., the bondant not necessarily contacting the covering).

Use of a non-woven fabric permits minor shifting (e.g., cracking, expansion, or contraction) of the surface to deform the fabric, without the force of the deformation being necessarily transmitted to the covering. As a result, shifting of the surface will not necessarily result in cracking or shifting of the covering. In the context of a grouted tile covering, for example, this property can inhibit, reduce, or prevent cracking of the tiled surface (i.e., cracking of tiles or of the grouted joints between them) that would result if the tile covering were applied directly to the surface (i.e., without the intervening fabric). Deformation of the surface can be compensated for by deformation or tearing of the fabric, which will not necessarily translate the deformation to the covering applied to the fabric.

Use of a non-woven fabric underlayment can aid removal of the covering at a time following its installation. If the cohesive strength of the non-woven fabric is less than the cohesive strength of the adhesive used to adhere the fabric to the surface and less than the cohesive strength of the bondant any additional adhesive(s) used to attach the covering to the fabric, then the fabric should tear internally before either the adhesive or bondant when appropriate removing-force is applied to the fabric. Use of a non-woven fabric underlayment can thereby result in a smooth (other than torn and disrupted fabric fibers) surface when the covering is removed from the wall. Application of a solvent of the adhesive to the surface can yield a substantially undamaged surface similar to the surface prior to installation of the fabric and covering.

A non-woven fabric can be porous. Porosity of the fabric facilitates drying of solvent-based adhesives used to adhere the fabric to the surface. Furthermore, a porous fabric can wick moisture from one part of the fabric to another. Such wicking can facilitate drying of any solvent-based bondant applied to the fabric. Wicking of moisture which penetrates the finished, covered surface can also facilitate drying, thereby improving the moisture resistance of the surface.

Beyond the requirements set forth herein, the composition of the non-woven fabric is not critical. The fabric comprises fibers of glass, wood, a synthetic polymer, or substantially any other material. The fibers are preferably cross-linked in order to provide lateral strength and coherence to the fabric. The fabric must exhibit sufficient coherent strength that, when one face of the fabric is adhered to a surface and the opposite face is bound to a covering, the two faces of the fabric do not separate substantially under ordinary conditions of the covered surface. For example, if the fabric is to be used as an underlayment in a vertical tiled bathroom wall, the fabric must exhibit sufficient coherent strength that it can at least support the weight of the tile covering (including any grout or caulk between the tiles) under the humid conditions anticipated in a bathroom.

The method used to cross-link the fibers is not critical. The fibers can be cross-linked simply by significantly intertwining the fibers, by chemically bonding them at fiber junctions, by thermally bonding them at fiber junctions, by embedding the fibers in a polymeric, inorganic, or other matrix, or any other known method. The lateral strength and coherence of the fabric depends on the type and extent of cross-linking in known ways. The lateral strength and coherence of the fabric also depends on the axial strength of the fiber or fibers used in the fabric. A skilled artisan is able to design or select a non-woven fabric suitable for use in the methods described herein in view of the environment and intended use of the surface being covered.

Mixtures of fibers can be used in the fabric. Such mixtures can, for example, exhibit the strength characteristic of some of the fibers while using the bulk of less expensive or more readily available fibers to fill out the fabric. By way of example, a mixture of glass fibers with paper pulp or a mixture of glass fibers with polyethylene fibers can be used to form a suitable fabric.

The thickness of the fabric is not critical. The fabric can be made as thin as will permit both adhesion of the fabric to the surface using the adhesive and binding of the bondant to the opposite face of the fabric. Thus, for adhesives and bondants which bind primarily at the surface of the fabric (i.e., without significant penetration into the fabric), a very thin fabric can be used. A thin fabric layer also has the advantage that such underlayment does not appreciably raise the pre-existing surface. A thicker and more porous fabric should be used when either the adhesive or the bondant must penetrate within the fabric in order to form a suitable bond therewith. By way of example, a mortar will generally bind better to a porous fabric than to a non-porous one.

One example of a fabric suitable for installation of ceramic tile to various surfaces is a non-woven fabric made from one or more of wood pulp, polyester fibers, and glass fibers. A bondant can be used to hold the fibers together in a unitary mass. One or both faces of the fabric can be treated in known ways to enhance the suitability of the fabric surface for binding with an adhesive or a bondant described herein.

The fabric can be flexible, relatively rigid, or very rigid. Flexible fabric has the advantage that it can be transported in rolls, folds, or other convenient forms. Flexible fabric can also be easier to work with at the site of surface covering installation, since it can be cut, bent, shaped, and the like to fit the needs of the particular installation. Rigid fabric can be provided in the form of sheets, preformed shapes, or other convenient forms.

The fabric can be installed flush with the surface to be covered with the covering. The adhesive can be used to smooth topographical abnormalities (pits, cracks, seams, or small lumps) in the surface to yield a smooth fabric surface. Alternatively, the fabric can be installed with seams, ridges, grids, or other topographical patterns for facilitating alignment or installation of the covering. By way of example, the fabric can have a pattern printed thereon, cuttable thread or string extending therefrom, or with substantially any other device or indication for facilitating installation of a covering thereupon.

The fabric can be cut to a desired size or shape prior to installation. The fabric can also be cut during installation (e.g., by wrapping flexible fabric around a fixture and cutting the non-fitting parts from the fabric). Alternatively, the fabric can be manufactured or provided in shapes designed to fit around commonly-encountered fixtures. By way of example, the fabric can be provided in a shape designed to fit around the base of a standard toilet or around the size of a typical sewer line.

Bondant

The covering is fixed to the fabric by way of a bondant. The covering can be fixed to the fabric directly with the bondant, by using the bondant to adhere the covering to the fabric. Alternatively, the bondant can be applied to the fabric and allowed to dry or set thereon, whereby the bondant becomes fixed to the fabric, and the covering can be bound to the bondant with a second substance, such as a thin-set mortar or an adhesive (e.g., a commercial tile adhesive) that binds both the bondant and the covering.

By way of example, the fabric can be adhered to a surface using an adhesive and a mortar, such as a thinset mortar, can be spread evenly on the non-adhered face of the fabric. After the mortar sets and/or dries. A second mortar coat can be applied to the existing mortar bondant and ceramic tile can be set in the second mortar coat, thereby fixing it to the fabric and the surface. The second mortar coat can be applied using ordinary tools and mortar installation methods to facilitate even tile installation.

The identity of the bondant is not critical. Substantially any adhesive, mortar, or other composition or any combination of such substances suitable for fixing the covering to the fabric can be used, so long as the bondant or combination provides a sufficiently tenacious and stable bond between the covering and the fabric that the covering does not significantly move or shift under the normal conditions to which the covering is subjected. As with the adhesive, the bondant or combination must exhibit the necessary tenacity and stability under the conditions characteristic of the particular installation (e.g., under humid, load-bearing conditions for the tile floor of a shower stall).

Cementitious bondants are preferred, in view of their ease of use, familiarity in the building trades, relative inexpensiveness, and their ability to bond tenaciously with non-woven fabrics, especially porous ones. Common mortars are useful in many, if not all situations. Any of the specialized mortars (e.g., moisture-resistant and stain-resistant mortars) known in the field can be used, however. Thinset mortars are preferred when a relatively thin (e.g., not greater than about ⅛ inch, after compression) bondant layer is desired. Thinset mortars can be used to prepare the surface of a fabric to receive a covering directly (i.e., by binding to both the fabric and the covering, such as ceramic tile) or as a surface preparation so that a covering can be fixed to the mortared surface using one or more additional mortars or other adhesives. Other mortars suitable for use as bondants include polymer-supplemented mortars (e.g., mortars containing latex or acrylic polymers), reinforced mortars (e.g., mortars containing fiberglass or other fibers), and epoxy mortars.

The bondant can be applied before or after the fabric is adhered to the surface, or even simultaneously with adhesion of the fabric to the surface.

When the bondant is used to fix the covering directly to the fabric, the bondant should be selected so that it binds to both the fabric and the covering with the tenacity and stability required by the particular application. When a second compound is used to fix the covering to the bondant, the bondant and the second compound should be selected such that the bondant binds with the fabric and the second compound binds with both the bondant and the covering with the required tenacity and stability. Selection of appropriate bondants and second compounds is within the ken of the skilled artisan in this field once the identities of the fabric and the covering are selected.

Covering

Substantially any covering that can be adhered to the fabric described herein can be applied to a surface using the methods described herein. The covering can, for example, be a rigid covering, such as tile, stone, brick, stucco, or a flexible covering, such as carpet, paper, paint, or cloth. Use of a topographically-smoothing adhesive and a non-woven fabric as described herein can significantly smooth the finish of a relatively rough surface, yielding aesthetically better results. In some instances, the smooth surface of the non-woven fabric is suitable for installation of certain 'soft' coverings, such as linoleum, peel-and-stick tiles, and the like, and it is not necessary to apply a cementitious bondant to the fabric. Using a cementitious bondant to bind the covering to the fabric or to coat the fabric prior to application of the covering can improve the smoothness of the covering.

The methods described herein are especially beneficial for installation of ceramic tile to a surface prone to cracking or shifting. Because ceramic tile and the grout typically installed between ceramic tile are each relatively brittle and rigid, they are not substantially resistant to cracking when the surface beneath them shifts. The non-woven fabric underlayment described herein is believed to insulate the a grouted tile covering by bending, tearing, flexing, or otherwise moving as the surface to which the fabric is adhered moves, without transmitting that movement to the covering bound to the opposite face of the fabric. Woven fabrics are more likely to transmit such movement from one face of the woven fabric to the other, and are therefore less suitable for the uses described herein.

Surfaces

The methods described herein can be used to apply a covering to substantially any surface. Any surface to which the non-woven fabric described herein can be adhered can be covered. Non-limiting examples of suitable surfaces include floors, walls, ceilings, countertops, tabletops, automobile body panels, window frames, surfaces of furniture and office equipment, and building exterior surfaces. Suitable coverings for exterior surfaces include stucco, tile, and other materials.

Prepared Underlayment

The invention includes an underlayment suitable for adapting a surface to receive a covering. The underlayment comprises a non-woven fabric of the type described herein, having a cementitious bondant disposed on at least one face of the fabric. The prepared underlayment facilitates easier performance of the methods described herein, because the step of apply the bondant to the fabric has already been performed. If desired, the prepared underlayment can also have an adhesive (e.g., a 'self-stick' adhesive faced by a removable waxed paper) disposed on the face opposite the bondant.

The prepared underlayment can be provided in forms each having a bondant layer of a different thickness. For example, the prepared underlayment can be provided in the form of sheets having a layer of bondant of about ⅛ inch, 1/16 inch, or some other standard thickness. Preferably, the cementitious bondant is one which forms a relatively cohesive thin layer, such as a thinset mortar or an epoxy mortar.

In one embodiment, the underlayment is provided in the form of flexible sheets. By way of example, a suitable flexible sheet can be bent at least 90 degrees along a three-inch segment without significant loss of bondant from the underlayment along the segment.

Kits

The invention includes a kit for preparing a surface to receive a covering. The kit can include as little as the non-woven fabric described herein and a cementitious bondant. Preferably, the kit also includes an adhesive for adhering the fabric to a surface. The kit can include an instructional material, such as a written instruction, an audio or video tape, an illustrated installation guide, or some other tangible medium for communicating how to perform the methods described herein.

The kit can be packaged or labeled for a particular application. By way of example, a kit having components suitable for preparing residential bathroom surfaces for installation of tile can include an adhesive, fabric, and bondant selected to exhibit suitable properties under the conditions anticipated in a residential bathroom environment. Other kits could, for example, include components selected to be suitable for preparing a surface to receive load-bearing or non-load-bearing wood panels.

In one embodiment, the kit includes the cementitious bondant disposed on one face of the fabric.

The disclosure of every patent, patent application, and publication cited herein is hereby incorporated herein by reference in its entirety.

While this invention has been disclosed with reference to specific embodiments, it is apparent that other embodiments and variations of this invention can be devised by others skilled in the art without departing from the true spirit and scope of the invention. The appended claims include all such embodiments and equivalent variations.

What is claimed is:

1. A method of preparing a surface to receive a covering, the method comprising binding one face of a non-woven fabric to the surface using an adhesive and applying to the opposite face of the fabric a cementitious bondant for receiving the covering, whereby minor deformation of the prepared surface is compensated for by deformation or tearing of the fabric and is not transmitted to the covering.

2. The method of claim 1, further comprising applying a second adhesive to the bondant.

3. The method of claim 2, further comprising adhering the covering to the bondant with the second adhesive.

4. The method of claim 1, wherein the fabric comprises glass fibers.

5. The method of claim 4, wherein the glass fibers of the fabric are fused to one another.

6. The method of claim 1, wherein the shape of the fabric is adapted to the shape of the surface.

7. The method of claim 1, wherein the fabric is flexible.

8. The method of claim 1, wherein the adhesive does not substantially shrink upon drying or setting.

9. The method of claim 1, wherein the adhesive is selected from the group consisting of epoxies, hot melt glues, contact cements, carpenter's glue, polyvinyl acetates, latex adhesives, silicone adhesives, acrylic adhesives, cyanoacrylate adhesives, and combinations thereof.

10. The method of claim 1, wherein the adhesive has a viscosity sufficiently low that it flows into gaps in the substrate prior to drying or setting.

11. The method of claim 10, wherein the viscosity and drying or setting time of the adhesive permit the adhesive to flow and form a substantially flat surface prior to applying the fabric to the surface and drying or setting of the adhesive.

12. The method of claim 1, wherein the adhesive is an acrylic polymer-based adhesive.

13. The method of claim 1, wherein the adhesive comprises at least about 10% acrylic polymers, at least about 10% of a hydrocarbon resin, at least about 5% of a substantially non-volatile oil, and not more than 70% water.

14. The method of claim 1, wherein the covering is tile and the Surface is a floor.

15. The method of claim 1, wherein the covering is tile and the surface is a wall.

16. The method of claim 1, wherein the bondant is a mortar.

17. The method of claim 16, wherein the mortar is a thinset mortar.

18. A method of binding a covering to a surface, the method comprising binding one face of a non-woven fabric to the surface using an adhesive and applying a cementitious bondant to the opposite face of the fabric, and thereafter binding the covering to the bondant, whereby minor deformation of the surface is compensated for by deformation or tearing of the fabric and is not transmitted to the covering.

19. A method of preparing a surface to receive a rigid covering, the method comprising binding one face of a non-woven fabric to the surface using an adhesive and applying to the opposite face of the fabric a cementitious bondant for receiving the rigid covering, whereby minor deformation of the surface is compensated for by deformation or tearing of the fabric and is not transmitted to the rigid covering.

* * * * *